US006170503B1

(12) United States Patent
Lin Shy

(10) Patent No.: US 6,170,503 B1
(45) Date of Patent: Jan. 9, 2001

(54) WATERPROOF SHELTER

(75) Inventor: Mei-Mei Lin Shy, Taichung Hsien (TW)

(73) Assignee: Taiwan Shin Yeh Enterprise Co., Ltd., Chia Yi Hsien (TW)

( * ) Notice: Under 35 U.S.C. 154(b), the term of this patent shall be extended for 0 days.

(21) Appl. No.: 09/246,324

(22) Filed: Feb. 9, 1999

(51) Int. Cl.[7] ..... E04H 15/64

(52) U.S. Cl. ..... 135/119; 135/115; 135/121; 135/120.3

(58) Field of Search ..... 52/3; 135/115, 135/119, 124, 120.3, 120.4, 121; 156/73.1, 73.4, 73.5; 478/57; 24/482

(56) References Cited

U.S. PATENT DOCUMENTS

| | | | | |
|---|---|---|---|---|
| 245,039 | * | 8/1881 | Williams | 24/482 |
| 4,335,490 | * | 6/1982 | Teachout | 24/482 |
| 4,605,578 | * | 8/1986 | Emrich et al. | 428/57 |
| 4,682,447 | * | 7/1987 | Osborn | 52/3 |
| 4,737,212 | * | 4/1988 | Emrich et al. | 156/157 |
| 4,852,598 | * | 8/1989 | Griesenbeck | 135/102 |
| 4,876,829 | * | 10/1989 | Mattick | 52/2 |
| 5,512,347 | * | 4/1996 | Chu | 428/81 |
| 5,573,026 | * | 11/1996 | Griffith | 135/122 |
| 5,584,311 | * | 12/1996 | Schaefer | 135/128 |
| 5,638,851 | * | 6/1997 | Baldwin | 135/124 |
| 5,746,856 | * | 5/1998 | Hendershot et al. | 156/73.4 |
| 5,885,679 | * | 3/1999 | Yasue et al. | 428/57 |
| 5,974,740 | * | 11/1999 | Park | 52/3 |

* cited by examiner

*Primary Examiner*—Robert Canfield
(74) *Attorney, Agent, or Firm*—William E. Pelton, Esq.

(57) ABSTRACT

A waterproof shelter includes a frame having two elongated first sides and two short second sides, a canopy mounted on the top of the frame and having two elongated first sides and two short second sides, two elongated side panels each mounted on one of the two first sides of the frame and each having a top side securely bonded to one of the two first sides of the canopy by means of a heat welding process, two end connecting panels each having a first side and a second side, the first side securely bonded to one of the two second sides of the canopy by means of a heat welding process, and at least one auxiliary sheltering panel mounted on one of the two second sides of the frame, and having a top side secured to the second side of one of the two end connecting panels.

9 Claims, 5 Drawing Sheets

WATERPROOF SHELTER

CROSS-REFERENCES TO RELATED APPLICATIONS

Not Applicable.

BACKGROUND OF THE INVENTION

1. Field of the Invention

The present invention relates to a waterproof shelter.

2. Description of the Related Art

A conventional waterproof shelter in accordance with the prior art shown in FIG. 6 comprises a frame (66), a canopy (60) mounted on the frame (66) and including two first connecting sides (602), and two side panels (61) each mounted on the frame (66) and each including two second connecting sides (612) each stitched to one of the two corresponding first connecting sides (602) of the canopy (60), thereby forming a seam (63). The canopy (60) is composed of a plurality of first canvas panels (600) stitched together, thereby forming a plurality of seams (604). Each of the two side panels (61) are composed of a plurality of second panels (610) which are stitched together, thereby forming a plurality of seams (614).

In such a manner, the seams (63, 604 and 614) are easily loosened or torn during long-term utilization, thereby forming leaks in the connection between the canopy (60) and the side panels (61) such that the shelter is not waterproof. The present invention has arisen to mitigate and/or obviate the disadvantage of the conventional waterproof shelter.

BRIEF SUMMARY OF THE INVENTION

In accordance with one aspect of the present invention, there is provided a waterproof shelter comprising a frame including two elongated first sides and two short second sides; a canopy mounted on the top of the frame and having two elongated first sides and two short second sides; and two elongated side panels each mounted on one of the two corresponding first sides of the frame and each having a top side bonded to one of the two corresponding first sides of the canopy by means of a high frequency heat welding process.

The waterproof shelter further comprises a plurality of retaining rings each secured in the periphery of the canopy, and a plurality of catches each abutting one of the corresponding retaining rings. Each of the catches includes a flexible cord having a first end extending through the respective retaining ring and through the frame, and a loop-shaped second end detachably mounted to the catch.

The waterproof shelter further comprises a plurality of retaining rings each secured in the periphery of each of the two side panels, and a plurality of catches each abutting one of the corresponding retaining rings and each including a flexible cord having a first end extending from the catch through the retaining ring and the frame, and a loop-shaped second end detachably mounted to the catch.

The waterproof shelter further comprises two end connecting panels each having a first side and a second side, the first side securely bonded to one of the two corresponding second sides of the canopy by means of a high frequency heat welding process.

The waterproof shelter further comprises at least one auxiliary sheltering panel mounted on one of the two second sides of the frame, and having a top side secured to the second side of one of the two end connecting panels. Each of the two end connecting panels includes a plurality of first snaps mounted on the second side thereof, and the auxiliary sheltering panel includes a plurality of second snaps mounted on the top side thereof and secured to one of the corresponding first snaps of the second side of the respective end connecting panel.

The waterproof shelter further comprises a plurality of retaining rings each secured in the periphery of the auxiliary sheltering panel, and a plurality of catches each abutting one of the corresponding retaining rings and each including a flexible cord having a first end extending from the catch and extending through the respective retaining ring and the frame, and a loop-shaped second end detachably mounted to the catch.

Further benefits and advantages of the present invention will become apparent after a careful reading of the detailed description with appropriate reference to the accompanying drawings.

DETAILED DESCRIPTION OF THE INVENTION

Figure 1:
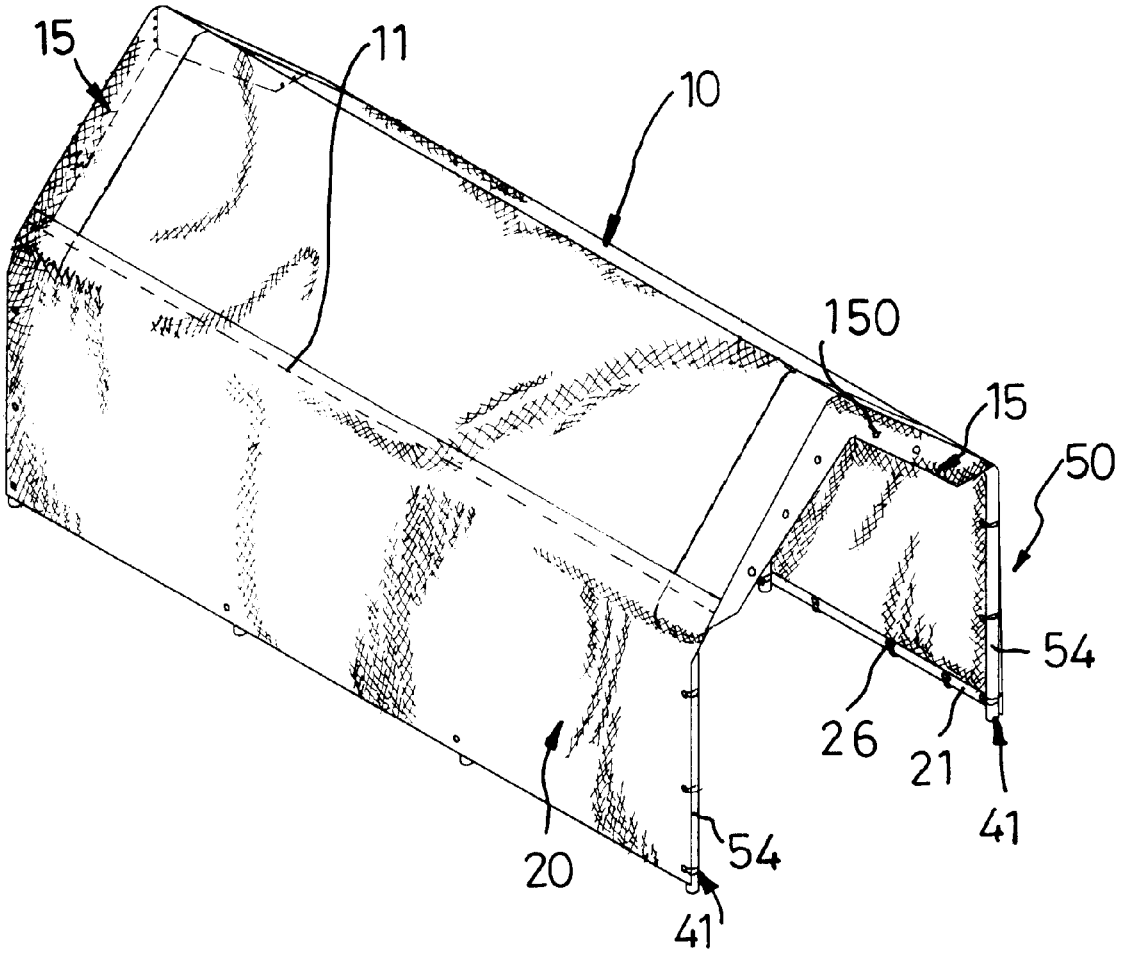
FIG. 1 is a perspective view of a waterproof shelter in accordance with the present invention.
Figure 2:
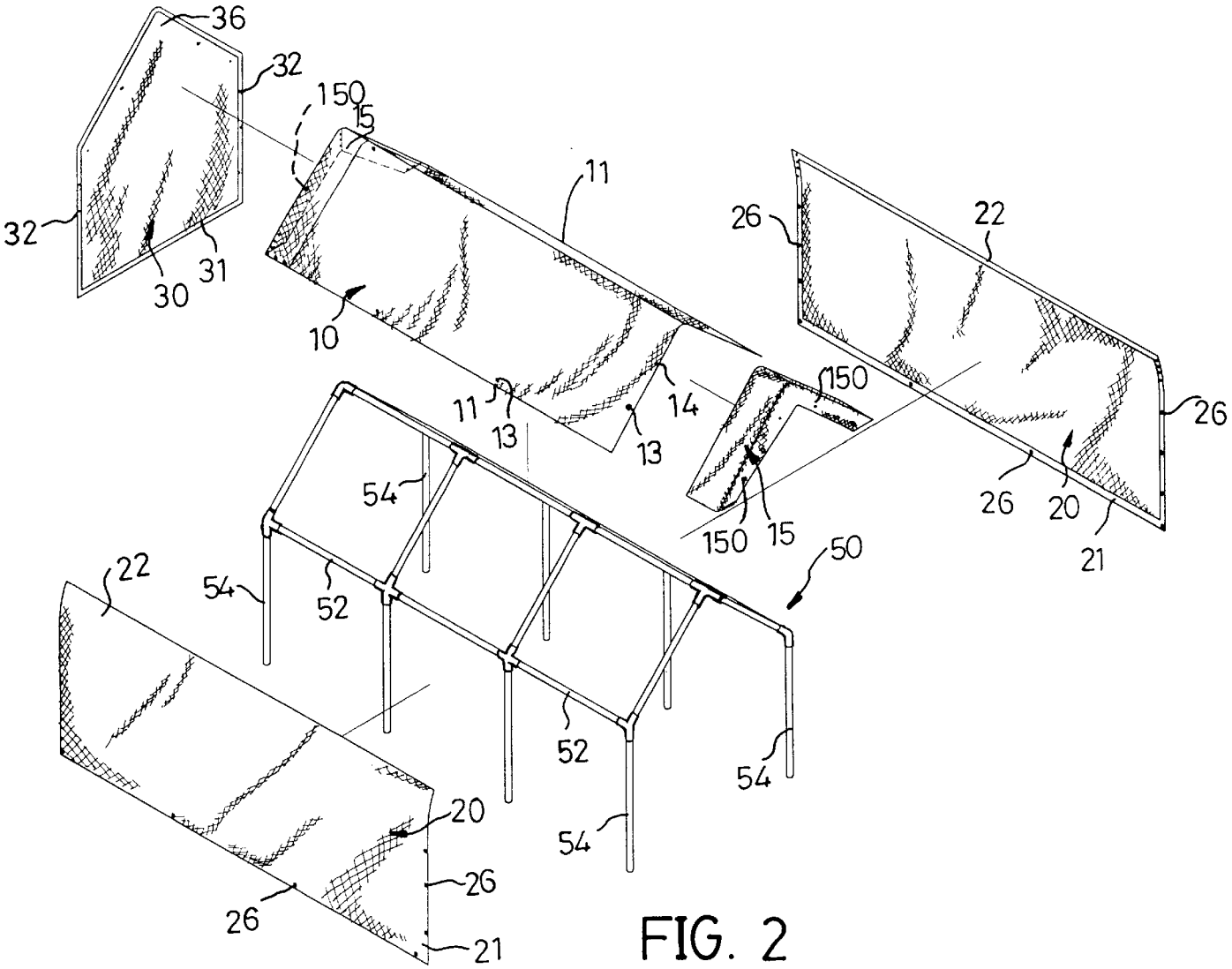
FIG. 2 is an exploded perspective view of the waterproof shelter as shown in FIG. 1.

Referring to FIGS. 1 and 2, a waterproof shelter in accordance with the present invention comprises a frame (50) including two elongated first sides and two short second sides, a canopy (10) mounted on the top of the frame (50) and having two elongated first sides (11) and two short second sides (14), two elongated side panels (20) each mounted on one of the two corresponding first sides of the frame (50) and each having a top side (22) securely bonded to one of the two corresponding first sides (11) of the canopy (10), two end connecting panels (15) each having a first side and a second side, the first side securely bonded to one of the two corresponding second sides (14) of the canopy (10), and an auxiliary sheltering panel (30) mounted on one of the two second sides of the frame (50), and having a top side secured to the second side of one of the two end connecting panels (15).

The frame (50) is essentially constructed by means of a plurality of cross rods (52) and a plurality of support stands (54).

Figure 3:
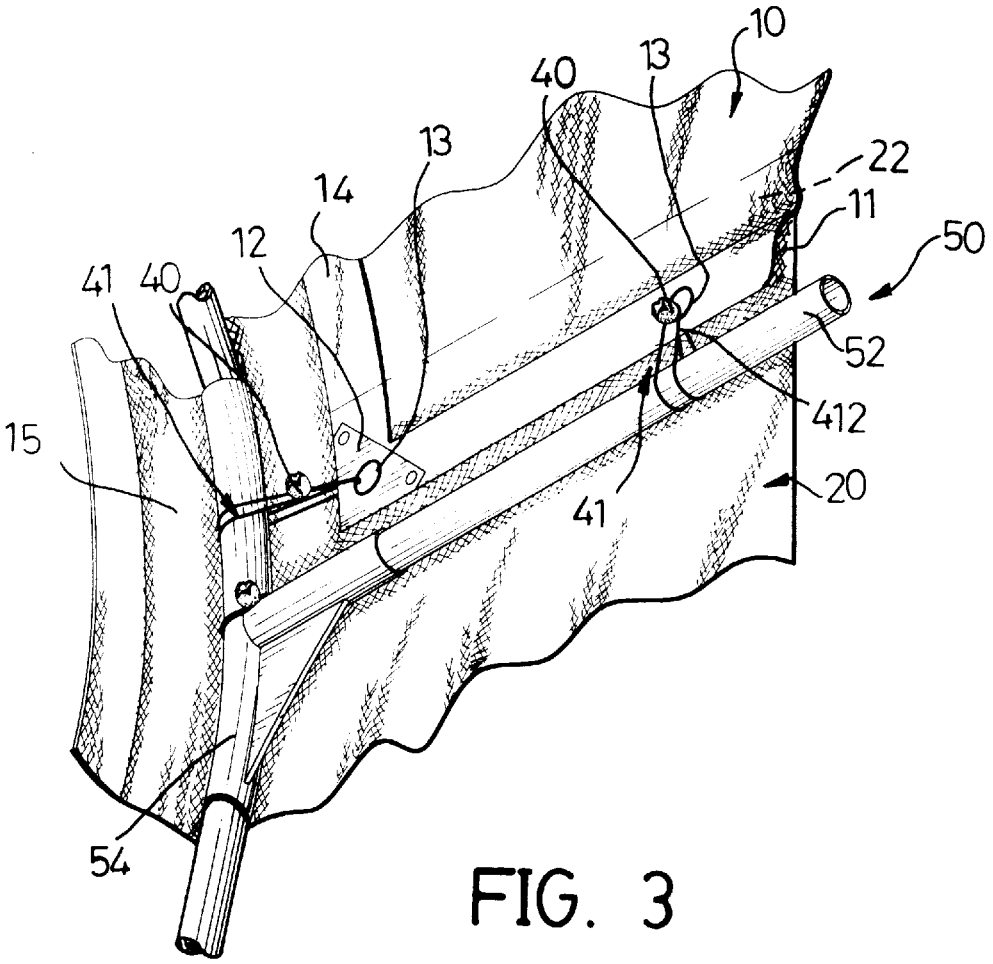
FIG. 3 is a partially cut-away bottom perspective view of the waterproof shelter as shown in FIG. 1.

Referring to FIGS. 1–3, the top side (22) of each of the two side panels (20) is bonded to the respective first side (11) of the canopy (10) by means of a high frequency heat welding process which uses a plurality of heating rollers (not shown) to heat and pressurize the top side (22) of each of the two side panels (20) and the respective first side (11) of the canopy (10), thereby securely bonding the top side (22) of each of the two side panels (20) to the respective first side (11) of the canopy (10). It is to be noted that part of the first side (11) of the canopy (10) is separated from the top side (22) of the side sheltering panel (20) as shown in FIG. 3. In a similar manner, the first side of each of the two end connecting panels (15) is bonded to the respective second side (14) of the canopy (10) by means of the high frequency heat welding process.

The waterproof shelter comprises a plurality of retaining rings (13) each secured in the periphery of the first side (11) and the second side (14) of the canopy (10), and a plurality of catches (40) each abutting one of the corresponding retaining rings (13). Each of the catches (40) includes a flexible cord (41) having a first end extending from the catch (40), and in turn extending through the respective retaining ring (13) and the cross rod (52) or the support stand (54) of the frame (50), and a loop-shaped second end (412) detachably mounted to the catch (40) as shown in FIG. 3, thereby fastening the canopy (10), the end connecting panels (15), and the side panels (20) to the frame (50).

The waterproof shelter further comprises a plurality of reinforcing strips (12) each secured on the periphery of the canopy (10), and each abutting one of the corresponding retaining rings (13).

Figure 4:
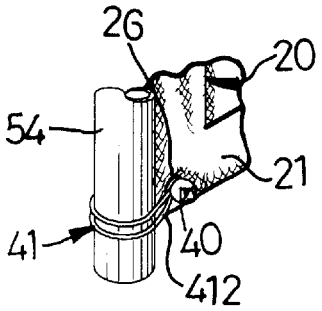
FIG. 4 is a partially cut-away view of the waterproof shelter as shown in FIG. 1.
Figure 5:
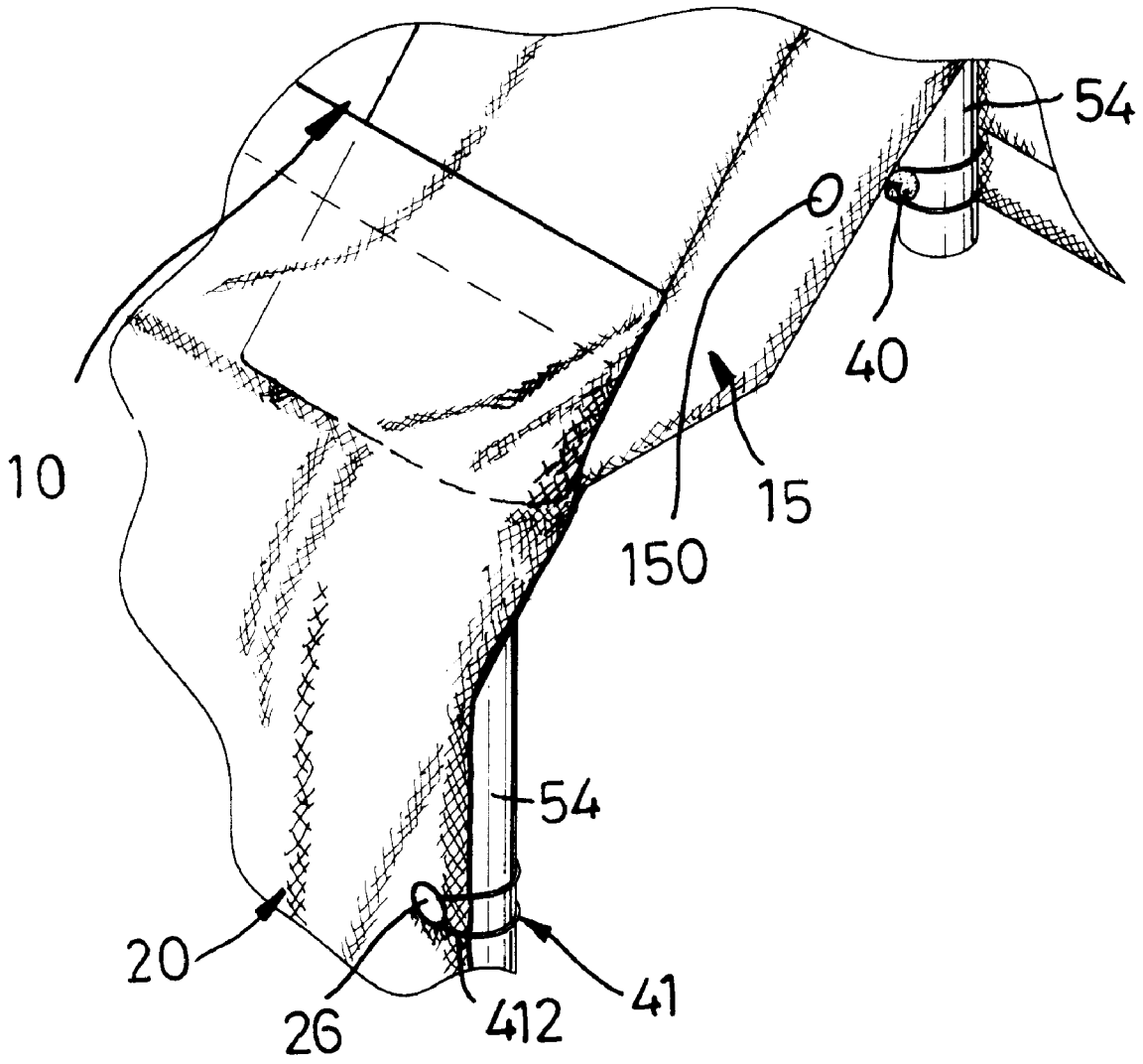
FIG. 5 is a partially cut-away view of the waterproof shelter as shown in FIG. 1.
Figure 6:
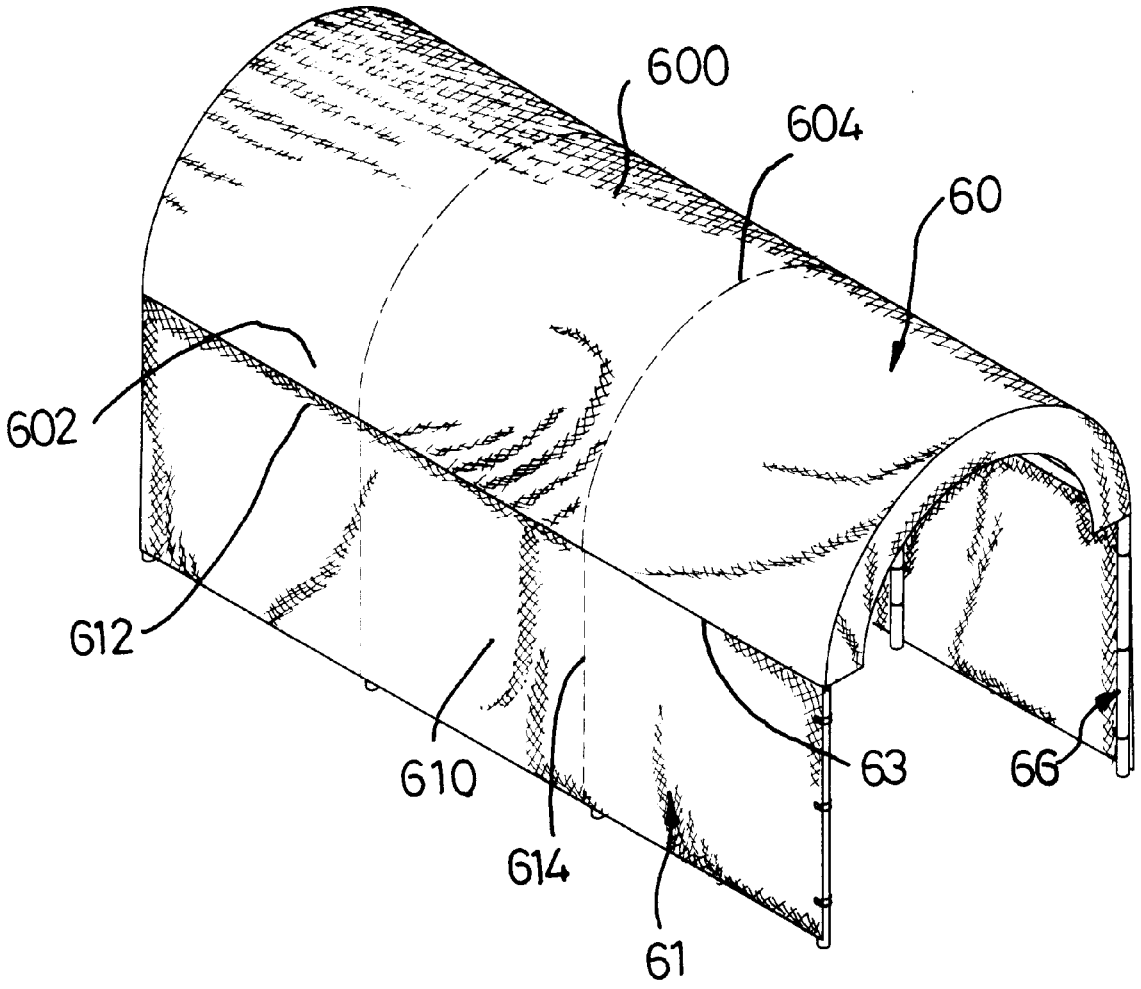
FIG. 6 PRIOR ART
FIG. 6 is a perspective view of a conventional waterproof shelter in accordance with the prior art.

Referring now to FIGS. 1–4, each of the two side panels (20) includes a peripheral portion (21), and the waterproof shelter further comprises a plurality of retaining rings (26) each secured in the peripheral portion (21) of each of the two side panels (20), and a plurality of catches (40) each abutting one of the corresponding retaining rings (26) and each including a flexible cord (41) having a first end extending from the catch (40), and in turn extending through the respective retaining ring (26) and around the support stand (54) of the frame (50), and a loop-shaped second end (412) detachably mounted to the catch (40) as shown in FIG. 4, thereby fastening each of the side panels (20) to the support stands (54) of the frame (50).

Referring now to FIGS. 1–5, each of the two end connecting panels (15) further includes a plurality of first snaps (150) mounted on the second side thereof, and the auxiliary sheltering panel (30) further includes a plurality of second snaps (36) mounted on the top side thereof and secured to one of the corresponding first snaps (150) of the second side of the respective end connecting panel (15), thereby attaching the auxiliary sheltering panel (30) to the end connecting panel (15).

The auxiliary sheltering panel (30) includes a peripheral portion (31), and the waterproof shelter further comprises a plurality of retaining rings (32) each secured in the peripheral portion (31) of the auxiliary sheltering panel (30). A plurality of catches (40) can each abut one of the corresponding retaining rings (32) and each includes a flexible cord (41) having a first end extending from the catch (40), and in turn extending through the respective retaining ring (32) and around the support stand (54) of the frame (50), and a loop-shaped second end (412) detachably mounted to the catch (40), thereby fastening the auxiliary sheltering panel (30) to the support stands (54) of the frame (50).

The top side (22) of each of the two side panels (20) is securely bonded to the respective first side (11) of the canopy (10) by means of the high frequency heat welding process such that the surface of each of the two side panels (20) is tightly and closely juxtaposed to the canopy (10), thereby providing a waterproof feature. In addition, the canopy (10), the side panels (20), and the auxiliary panels (30) are fastened to the frame (50) by means of the catches (40) in conjunction with the flexible cords (41) which are easily connected with and detached from each other, thereby facilitating assembly of the shelter. Further, the auxiliary sheltering panel (30) is attached to the end connecting panel (15) by means of the first snaps (150) in conjunction with the second snaps (36) which are easily connected with and detached from each other, thereby facilitating assembly of the shelter.

It should be clear to those skilled in the art that further embodiments may be made without departing from the scope and spirit of the present invention.

What is claimed is:

1. A waterproof shelter comprising:

a frame including two elongated first sides and two short second sides;

a canopy mounted on the top of said frame and having two elongated first sides and two short second sides;

two elongated side panels each mounted on one of said two corresponding first sides of said frame and having a top side securely bonded to one of said two corresponding first sides of said canopy;

a plurality of retaining rings in the periphery of said canopy; and a plurality of catches each including a flexible cord extending through one of said retaining rings and around said frame and terminating in a loop-shaped end detachably mounted to said catch.

2. The waterproof shelter in accordance with claim 1, wherein said top side of each of said two side panels is securely bonded to said respective first side of said canopy by means of a high frequency heat welding process.

3. The waterproof shelter in accordance with claim 1, further comprising a plurality of reinforcing strips each secured on the periphery of said canopy, and each abutting one of said corresponding retaining rings.

4. The waterproof shelter in accordance with claim 1, wherein each of said two side panels includes a peripheral portion having a plurality of retaining rings, the waterproof shelter further comprising a plurality of catches each including a flexible cord extending from said catch through a respective retaining ring and around said frame, and having a loop-shaped end detachably mounted to said catch.

5. The waterproof shelter in accordance with claim 1, further comprising two end connecting panels each having a first side and a second side, said first side securely bonded to one of said two corresponding second sides of said canopy.

6. The waterproof shelter in accordance with claim 5, wherein said first side of each of said two end connecting panels is bonded to said respective second side of said canopy by means of a high frequency heat welding process.

7. The waterproof shelter is accordance with claim 5, further comprising at least one auxiliary sheltering panel mounted on one of said two second sides of said frame, and having a top side secured to said second side of one of said two end connecting panels.

8. The waterproof shelter in accordance with claim 7, wherein each of said two end connecting panels further includes a plurality of first snaps mounted on the second side thereof, and said auxiliary sheltering panel further includes a plurality of second snaps mounted on the top side thereof and secured to one of said corresponding first snaps of said second side of said respective end connecting panel.

9. The waterproof shelter in accordance with claim 7, wherein said auxiliary sheltering panel includes a peripheral portion, and said waterproof shelter further comprises a plurality of retaining rings each secured in said peripheral portion of said auxiliary sheltering panel, and a plurality of catches each abutting one of said corresponding retaining rings and each including a flexible cord having a first end extending from said catch, and extending through said respective retaining ring and around said frame, and a loop-shaped second end detachably mounted to said catch.

* * * * *

UNITED STATES PATENT AND TRADEMARK OFFICE

CERTIFICATE OF CORRECTION

PATENT NO. : 6,170,503 B1
DATED : January 9, 2001
INVENTOR(S) : Mei-Mei Liu Shy

It is certified that error appears in the above-identified patent and that said Letters Patent is hereby corrected as shown below:

Title page,
Please change Item [12] from "Lin Shy" to -- Liu Shy --; and
Please change Item [75] from "Mei-Mei Lin Shy" to -- Mei-Mei Liu Shy --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*